United States Patent [19]

Schröck

[11] Patent Number: 4,578,982

[45] Date of Patent: Apr. 1, 1986

[54] RADIAL PRESS FOR WORKPIECES HAVING A CYLINDRICAL EXTERIOR SURFACE

[76] Inventor: Peter Schröck, Krögerstr. 5., D-6000 Frankfurt/Main-1, Fed. Rep. of Germany

[21] Appl. No.: 645,023

[22] Filed: Aug. 28, 1984

[30] Foreign Application Priority Data

Sep. 2, 1983 [DE] Fed. Rep. of Germany ..... 3331721

[51] Int. Cl.[4] ..... B21D 41/00

[52] U.S. Cl. ..... 72/402; 29/237; 29/243.52; 72/451

[58] Field of Search ..... 72/402, 451; 29/237, 29/243.52, 283.5

[56] References Cited

U.S. PATENT DOCUMENTS 684,216 10/1901 Cadman .
4,306,442 12/1981 Schrock ..... 72/402

FOREIGN PATENT DOCUMENTS 1241683 11/1967 Fed. Rep. of Germany .
2214339 8/1976 Fed. Rep. of Germany .
2751101 5/1979 Fed. Rep. of Germany .
2081144 2/1982 United Kingdom .

*Primary Examiner*—W. D. Bray
*Attorney, Agent, or Firm*—Felfe & Lynch

[57] ABSTRACT

A radial press for workpieces (26) having a cylindrical outer surface, comprises toggle levers (10) movable in a radial plane and having inner and outer ends. The radial press has a press casing (6) comprising at least two parts (18, 19) and having radial guides (5) and guide bodies (4) for a plurality of dies disposed about the axis of the outer surface of the workpiece and driven by toggle levers (10). The press casing has a compression ring (8) guided concentrically to an axis (A—A) with outer pivot points (9) for the toggle levers. A circumferential rim (34) is provided on the casing parts on both sides, each rim overlapping the compression ring (8), and the compression ring (8) being supported thereon through rotational guides (20). The casing parts form one unit clamped together by bolts passing through both casing parts. Between the rotational guides (20) and the compression ring (8) there is present a radial clearance of such small magnitude that a polygonal deformation of the compression ring (8) in the pressing process is as small as possible.

14 Claims, 9 Drawing Figures

RADIAL PRESS FOR WORKPIECES HAVING A CYLINDRICAL EXTERIOR SURFACE

Figure 1:
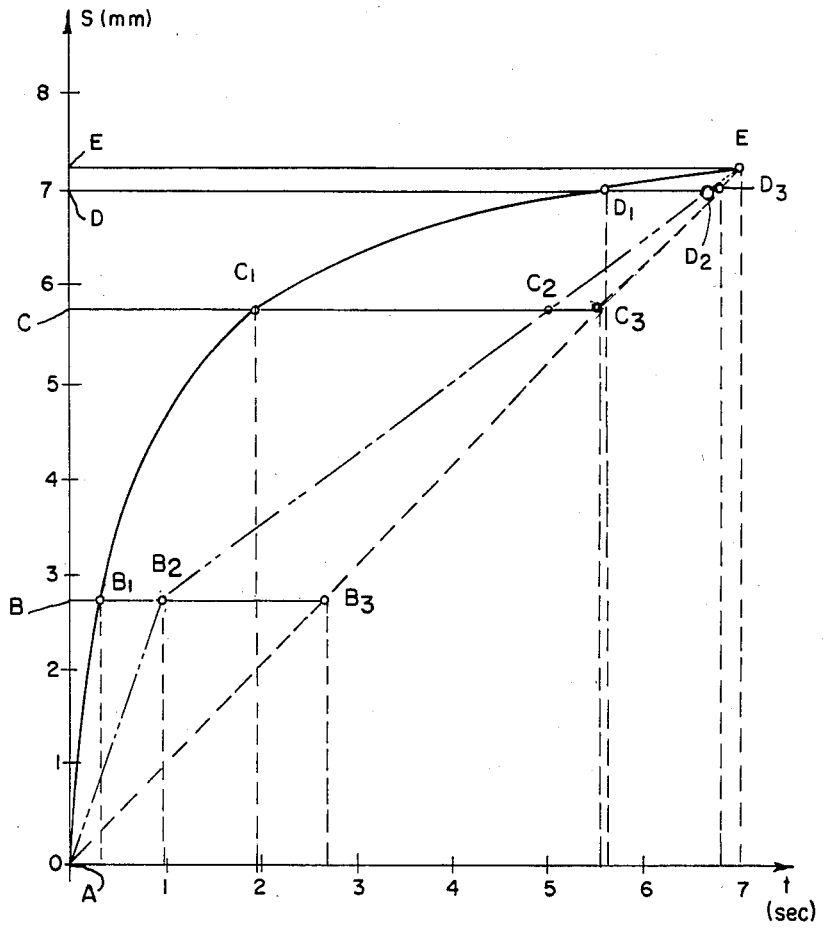

The invention relates to a radial press for workpieces having a cylindrical exterior surface, especially for fastening fittings consisting of a sleeve and nipple to hoses by mechanically deforming the sleeve against the hose situated between nipple and sleeve, the press having toggle levers movable in a radial plane and a press casing consisting of at least two parts and having radial guides and bodies for guiding a plurality of dies disposed in a circle about the axis of the outer surface of the workpiece, each guiding body having an inner pivot for the inner end of the toggle lever, a compression ring guided concentrically with the axis with outer pivots for the outer ends of the toggle levers, and a drive for the synchronous movement of all dies by relative rotation of the outer pivots with respect to the inner pivots.

U.S. Pat. No. 684,216 discloses a radially acting die press which is designed especially for making twist drills. The two-piece press casing serves, however, only for the axial and therefore virtually force-free guidance of the dies; but it cannot withstand any radial forces. The compression ring consequently has a considerable cross section, so that its relatively great weight is borne at the lowermost point by a support which, however, extends only over a part of the circumference of the compression ring and consequently is unable to absorb the reaction forces of the dies, which tend to expand the compression ring to a polygon. Such a press is not suitable for the compression of thick-walled fittings onto hoses.

German Pat. No. 12 41 683 (this is the basis for the genus, with the exception of the field of application to "hoses") discloses a radial press in which the compression ring is guided centrally with respect to the press casing by a roller or friction bearing. There is no indication, however, that the outer support ring, which is not further specified, is formed on one of the casing parts, and that the casing parts form with one another a torsion-resistant assembly which is capable of absorbing even those radial reaction forces which, in the case of great pressing forces, result in an expansion of the compression ring. Without special constructional measures, therefore, the outer support ring can serve only for the central guidance of the compression ring, but not for the absorption of radial forces on the entire circumference.

German Publication OS No. 27 51 101 discloses a radial press in which the radial guides of guiding bodies are rotated relative to a stationary and rigid press casing. This is accomplished by means of a hollow shaft, referred to as a spindle, which, however, considerably increases the axial length of the press.

In radial presses for joining hoses to metal fittings, however, problems arise. The hoses involved are multilayer high-pressure hoses of elastomeric material, preferably rubber, having reinforcements, preferably steel wire meshes. The outer layer of the elastomeric material is, as a rule, stripped away before pressing into the armature. The finished hoses are suitable for pressures up to 1000 bar and more and are used preferentially in hydraulic drives.

Important in this connection is also the nature of the nipple and sleeve. As a rule, circumferential ribs or grooves are provided on the nipple, and also the sleeve has ribs or grooves on its inner circumferential surface, which in axial cross section form a kind of sawtooth profile. The material is high-strength, plastically deformable steel. When the pressing is performed, the circumferential ribs of the sleeve bury themselves into the hose material, the "chambers" situated between the ribs being filled by a kind of flowing process with the elastomeric material, and the reinforcement assuming a wavy structure which matches the surface configuration of the nipple and sleeve. In this manner a kind of interlocking develops between nipple, hose and sleeve, which withstands high internal pressures and the resultant axial forces.

In the forming process, the nipple must be prevented under all circumstances from yielding under the press pressure by reducing its inside diameter, thus unacceptably reducing the tube cross section. This impairs the pinching grip of the fitting on the hose, because the nipple fails to support it sufficiently. This danger exists especially at high pressing speeds, when the elastomeric material is not given sufficient time to flow in and fill the "chambers." Moreover, the material of the sleeve, usually automatic steel, tends to embrittle at high deformation speeds, so that the sleeve may break during the pressing process or later. This is especially the case in the area where the material is upset between the initially spaced-apart dies. In consideration of the intended application, on the one hand, and of the desire for versatility on the other, the following requirements are to be made of radial presses of this kind:

(a) high closing force,
(b) long radial die movement,
(c) high pressing force at the end of the radial stroke,
(d) shallow construction, i.e., small depth along the axis of the fittings,
(e) precise radial guidance of the dies toward the axis of the fittings,
(f) symmetrical distribution of the reaction forces,
(g) low installed power, and
(h) simple, sturdy and inexpensive construction.

On the above requirements it is also to be commented that points (b) and (c) are diametrically opposed. A long radial movement of the dies is necessary in order to be able to install fittings of complicated shape, such as 90-degree elbows. This requires a high step-up ratio between the drive and the die movement. A high closing force at the end of the travel of the dies, however, necessitates a low step-up ratio, a step-down if possible.

Point (d) must be considered in connection with fittings of complex shape. Point (g) is to be considered with a view to the total weight of the radial press, because a high installed power will result, in the case of hydraulic power systems, in hydraulic cylinders of great cross section, which are heavy because of the strength they require. In the past it has been extraordinarily difficult to reconcile these requirements.

German Pat. No. 22 14 339 discloses a radial press of the kind described above, in which the required great radial stroke of the dies is made possible by the fact that a compression ring, whose inner conical surface forms the surface that operates the dies, is disposed for axial displacement independently of the hydraulic or pneumatic drive. In the known case, the axial displacement of the compression ring is accomplished by mounting it in a press frame for displacement manually by means of a screw thread. For the purpose of inserting a hose fitting, first the movable part of the press frame is moved hydraulically until it makes contact, and then the compression ring is additionally unscrewed further out by hand until the dies have reached their outermost position. This process is repeated in reverse in making the junction between the hose fitting and the hose. Accordingly, however, the cycle time required for making a junction by compression is long, so that the known radial press is of only very limited suitability for use on a production scale. The chief disadvantage, however, is the constant ratio between deformation movement and deformation time, i.e., a oonstant radial velocity of the dies during the actual pressing stroke. As a result, only a relatively brief time is available for the plastic deformation of the fitting parts forming the junction, and this is detrimental to the optimum flow of the materials. Furthermore, a compromise must be found between the deformation speed and the maximum pressing power at the end of the radial stroke of the dies, which makes it impossible to fulfill all of the requirements. Also, a correspondingly great axial length of the entire press is required, which therefore permits the application of fittings of complex shape only because the hydraulic drive and the die control are joined together by bolts.

The interrelationships between deformation stroke and deformation time, and the resultant rate of deformation will be further explained on a comparative basis in the detailed description to be given with the aid of FIG. 1. All that will be said at this point is that, in the case of the known approach described above, the radial velocity of the dies is constant, assuming that the rate of delivery to the hydraulic drive is constant.

German Pat. No. 28 44 475 discloses a radial press of the kind described in the beginning, in which the conflicting requirements for a great radial stroke on the one hand and a high closing force at the end of the radial stroke on the other hand were at least partially solved by providing for two stages on the contact surfaces of the dies. The engaging contact surfaces initially have a steep slope to cover the so-called idle stroke or approach travel, and then a lower slope for the actual pressing stroke. This results in a break in the characteristic curve which is composed, however, of two linear sections, as will be explained with the aid of FIG. 1. In this case a so-called ring piston of large outside diameter serves for the drive, which considerably shortens the axial dimensions, but on the other hand, on account of the sealing that is needed, requires careful machining of the friction surfaces and work to maintain them. Although the two contact surfaces counteract any tendency of the dies to tilt, the force curve is relatively unfavorable, so that the position of the dies has to be stabilized by strong dovetail guides. Furthermore, great axial forces are produced by such a principle of design, which can be absorbed only to a limited degree by an abutment on which the dovetail guides are also fastened, and this is because the annular disk-like abutment tends under the high axial forces to undergo a resilient deformation in the manner of a cup spring. The reason for this is to be seen in the fact that the abutment can be bolted to the hydraulic cylinder only at its outer circumference. Despite the considerable complexity of the design, naught but relatively short periods are available at the end of the compression stroke for the plastic deformation of the parts at the junction, so that the flow does not take place in the best possible manner. Nevertheless, at a closing force of, for example, 300 tons at the end of a pressing stroke, distributed over a total of eight dies, reaction forces of 100 tons must be absorbed axially by the annular support. The ring piston in the example described above must have a cross-sectional area of about 320 square centimeters at a stroke of 60 mm. The hydraulic unit required for this purpose must thus still have a very considerable amount of power.

To facilitate the insertion of hose fittings and hoses, radial presses for production purposes are already known, in which the actual radial press is radially divided and foldable. This, however, results in a weakening of the essential element of the press. In particular, the front plate of the press, which also has to absorb the reaction forces of the entire press frame, must be of slotted construction, requiring a complex design for the purpose of at all achieving the necessary strengths. The folding up of the die when loading the press also results in the loss of valuable time in the production process.

It is therefore the object of the invention to devise a radial press of the kind described above, which not only fulfills the requirements established above, but in which the time-distance characteristic or power-distance characteristic will be much better adapted to the deformation properties of cylindrical workpieces, especially in the metal-rubber-metal combination.

It is especially the object of the invention to produce a large pressing force at the end of a long radial movement, and at the same time to reduce the polygonal deformation of the compression ring by the design of the press casing, combined with a simple construction of the press.

The solution of the stated object is achieved by the combination of the following features:

(a) On each of the casing parts there is a circumferential rim overlapping the compression ring, and against it the compression ring thrusts on its entire circumference through the medium of rotational guides disposed on the circumferential rim, (b) The casing parts are formed into a torsion-free unit clamped together by a series of bolts passing through both casing parts, and (c) Between the rotational guides and the compression ring there is a radial clearance of such small size that any polygonal deformation of the compression ring in the pressing action will be minimal.

This method of construction leads to the following benefits:

At the high press pressures such as occur especially in the production of connecting hoses, the compression ring is subject to a resilient radial expansion which, due to the point-like or linear thrust of the toggles against the outer pivots, tends to deform the compression ring to a polygon.

Due to the measure taken by the invention according to feature (a), an important part of the radial forces is transmitted in all radial directions to the circumferential rims and from there to the casing parts. Thus, in contrast to the state of the art, the casing parts bear not only the weight of the compression ring but also a considerable part of the reaction forces of the pressing action. It is to be noted in this regard that the two casing parts have, at the critical point, a vertical cross section which, at an equal expenditure of material, has several times the moment of resistance of the compression ring itself. Even if the concentration of material in the compression ring itself were twice as great, it could not produce such a great moment of resistance to the radial forces. Basically, the compression ring could even be composed of ring sectors without thereby making the press incapable of working.

This increase in strength is further substantially augmented by the fact that the casing parts are clamped together by a series of bolts which pass through both parts of the casing. In this manner, the press casing is given on its circumference an at least partial U-shaped cross section which profits from the rigidity of the casing parts. This is because these casing parts constitute in principle plate-like disks which of themselves have a great stiffness which is further improved by the bolts. In this manner the compression ring is gripped in a form-fitting yet rotatable manner between the casing parts, so that the radial forces, minus the radial forces already taken up by the resilience of the compression ring, are transmitted to the casing parts.

By feature (c) it is brought about that the portion of the reaction forces that is transmitted by the compression ring to the press casing is as great as possible. The smaller the radial clearance is, the greater is the portion of the radial forces that are taken up by the press casing. The radial clearance, of course, cannot be reduced to zero, because then the movement of the compression ring would be impaired. But on the other hand it is also to be understood that the radial clearance cannot be too great, because then the polygonal deformation of the compression ring during the pressing action would increase. At the same time, the forces which are applied to the compression ring in the circumferential direction (tangential stresses), and the flexural stresses (polygonal deformation), must not exceed acceptable levels. From this it can be seen that the radial clearance in question should be made quite small, because thus it will be possible to make the compression ring correspondingly thin and to shift the stability-of-shape requirement to the press casing, because there it is possible to achieve a much greater stability of shape with the same or even a substantially reduced expenditure of material.

By selecting a minimal radial clearance the precision of the pressing process is substantially improved, i.e., all of the toggle levers will have the same angular position with respect to a corresponding radius at the same moment of time. This is important because, particularly when the toggle levers are close to the so-called "straight-out position," very high pressing forces are generated.

It is especially advantageous for the circumferential rims which overlap the compression ring to be formed integrally on the casing parts and to overlap the compression ring from both sides for a total of more than half of the axial length of the compression ring. In an especially desirable manner, the distance between the confronting surfaces of the circumferential rims is selected such that there is just enough room between them for the compression ring arm which is engaged by the hydraulic or pneumatic driver.

It is furthermore especially advantageous for the casing parts to be of substantially mirror-image symmetrical construction and arrangement, and for each to have the following elements:

(a) the rotational guiding means for the compression ring,
(b) rotational guiding means for the outer pivot points of the toggle levers,
(c) radial guides for the die guiding bodies, and
(d) a concentric row of bores for the body bolts inside of the rotational guiding means of the compression ring.

It is, again, especially advantageous for the casing parts, aside from the radial guides and the bores for the body bolts, to be a pure rotational body, and to be provided in its lower portion with separate attached plates for mounting the drive means.

The casing parts can be in the form of investment moldings or precision castings which require very little machining for the production of the individual guides and bores.

It is furthermore advantageous for the casing parts to be provided with circumferential ribs raised axially inwardly and abutting one another adjacent the bores provided for the body bolts, and for them to be clamped together by means of the bolts. In this manner the press casing will have the shape of a "U" in the area of its heavily stressed cross section, whose resistance to deformation (expansion and torsion) is considerable.

Other advantageous developments of the subject matter of the invention will be found in the rest of the subordinate claims; their advantages are further explained in the detailed description.

An example of the subject matter of the invention will be explained hereinbelow in conjunction with FIGS. 1 to 9.

Figure 2:
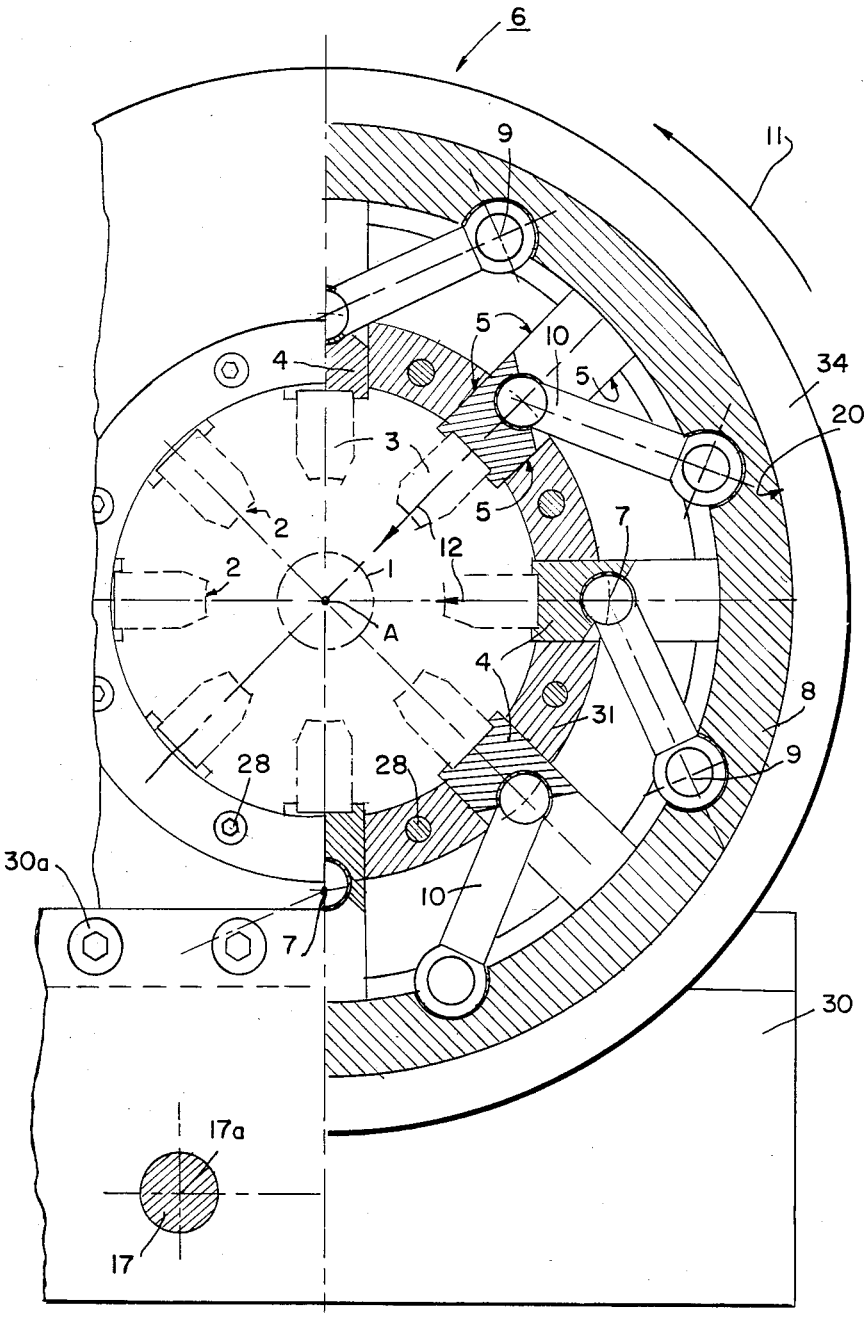
Figure 3:
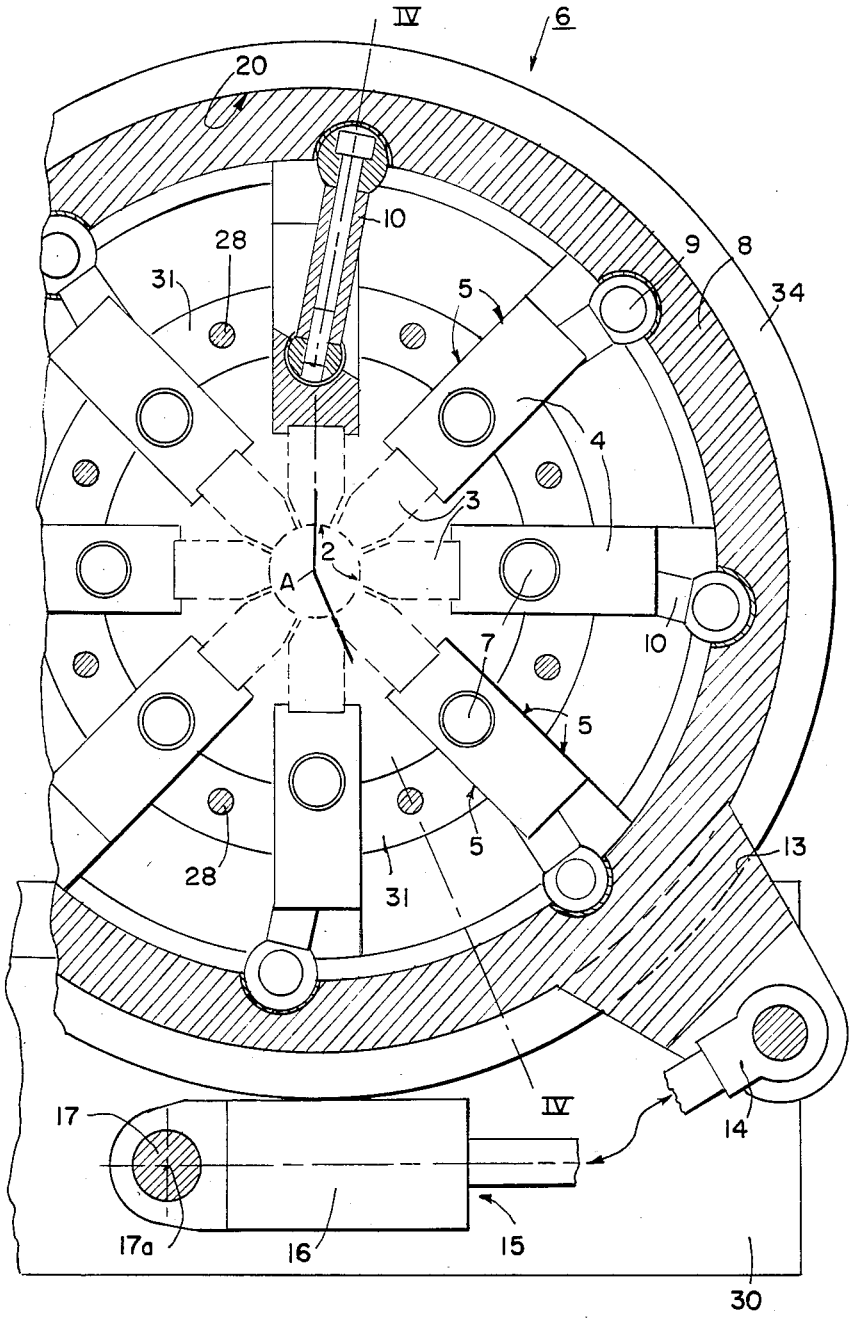
Figure 4:
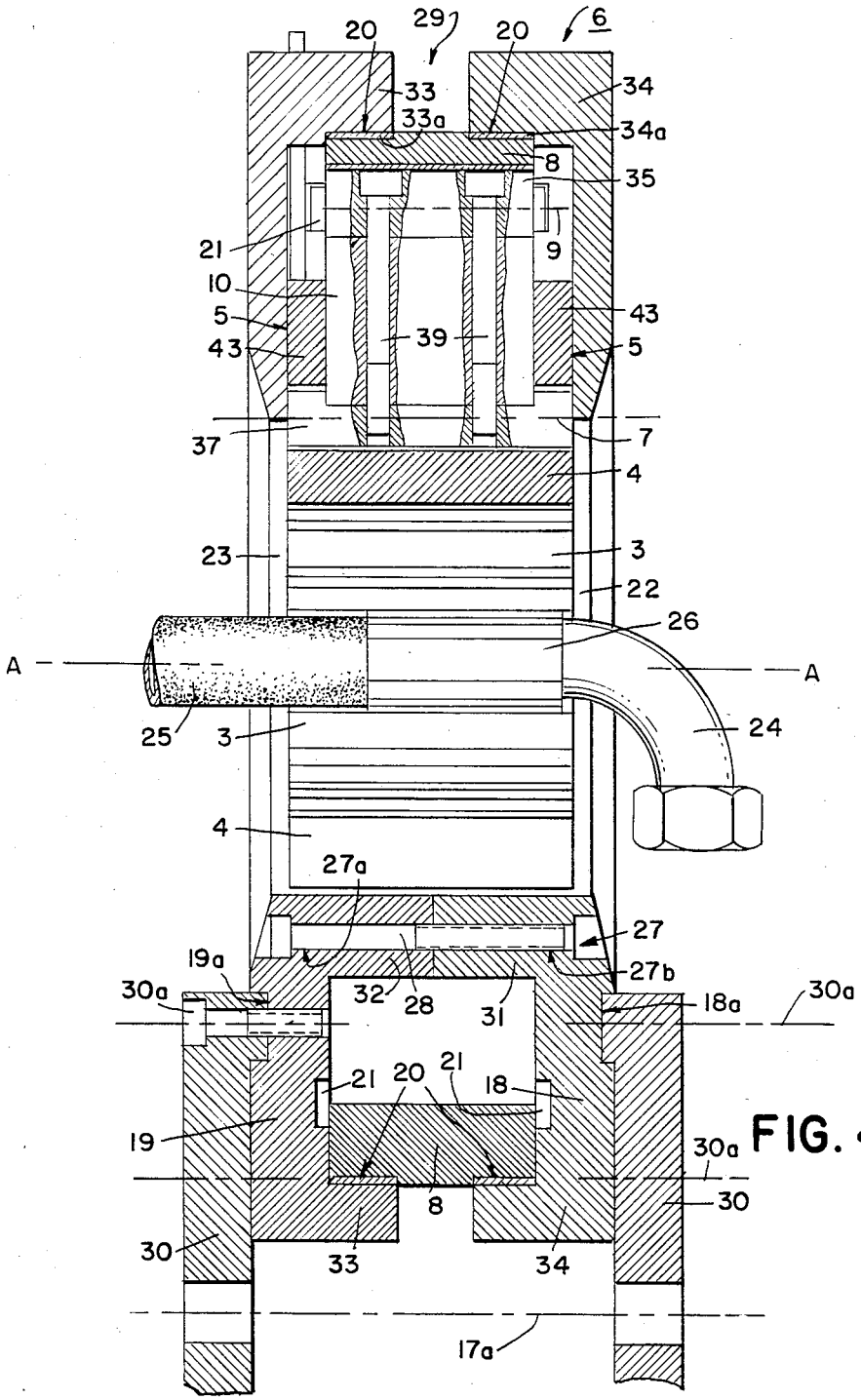
Figure 5:
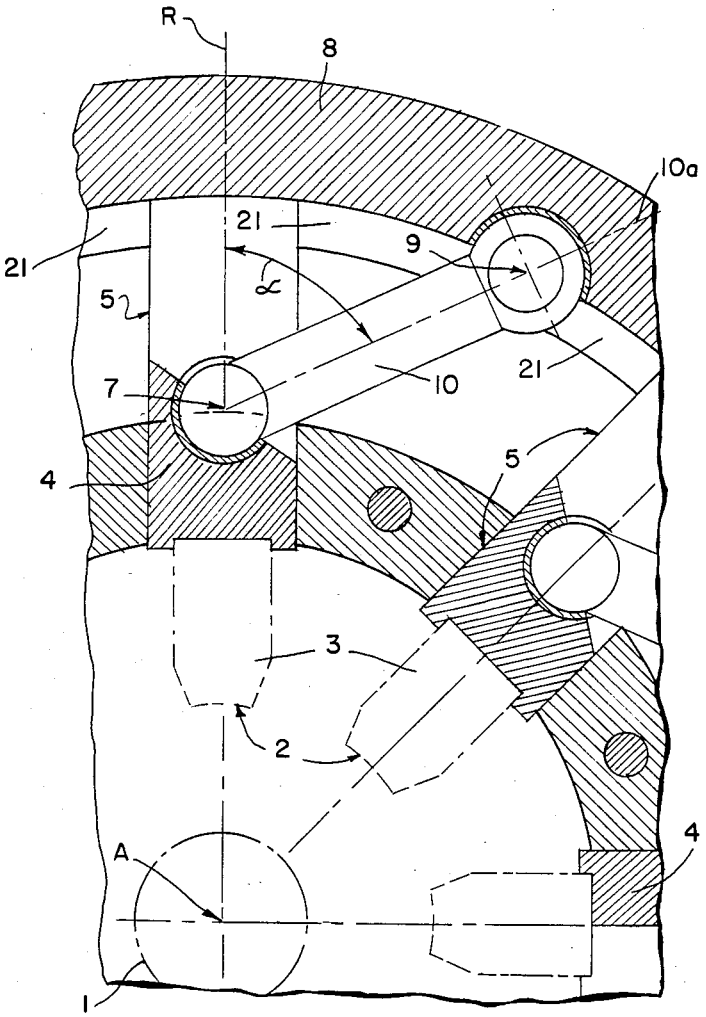
Figure 6:
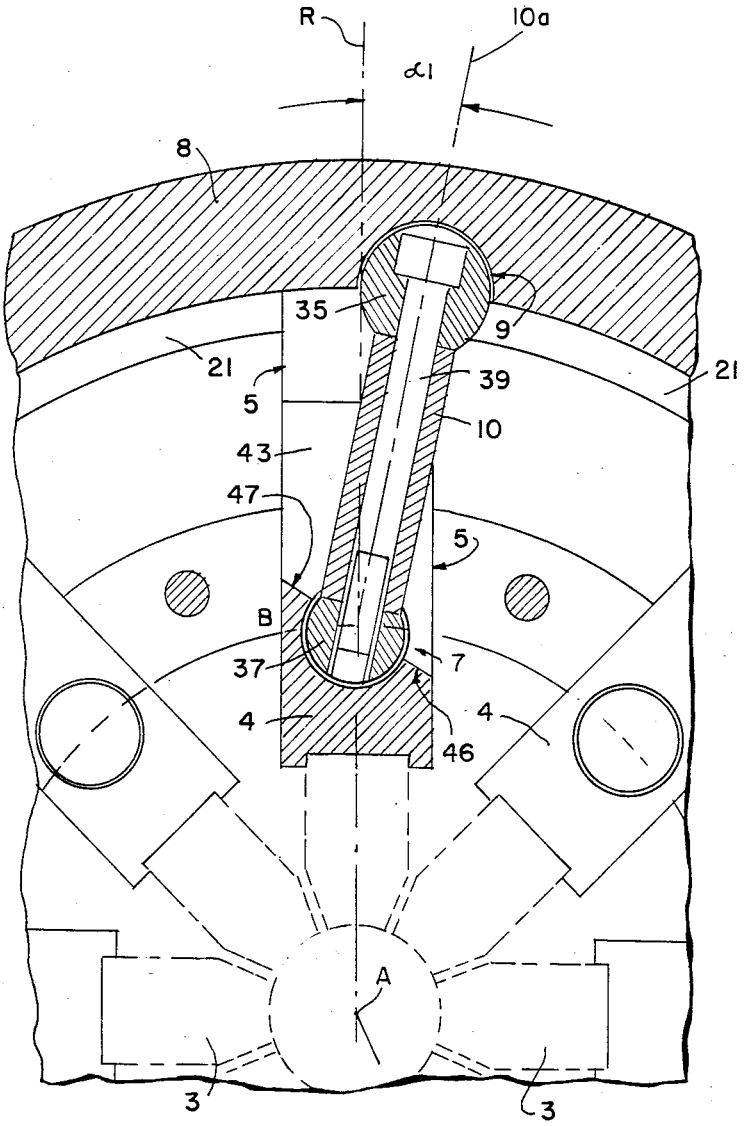
Figure 7:
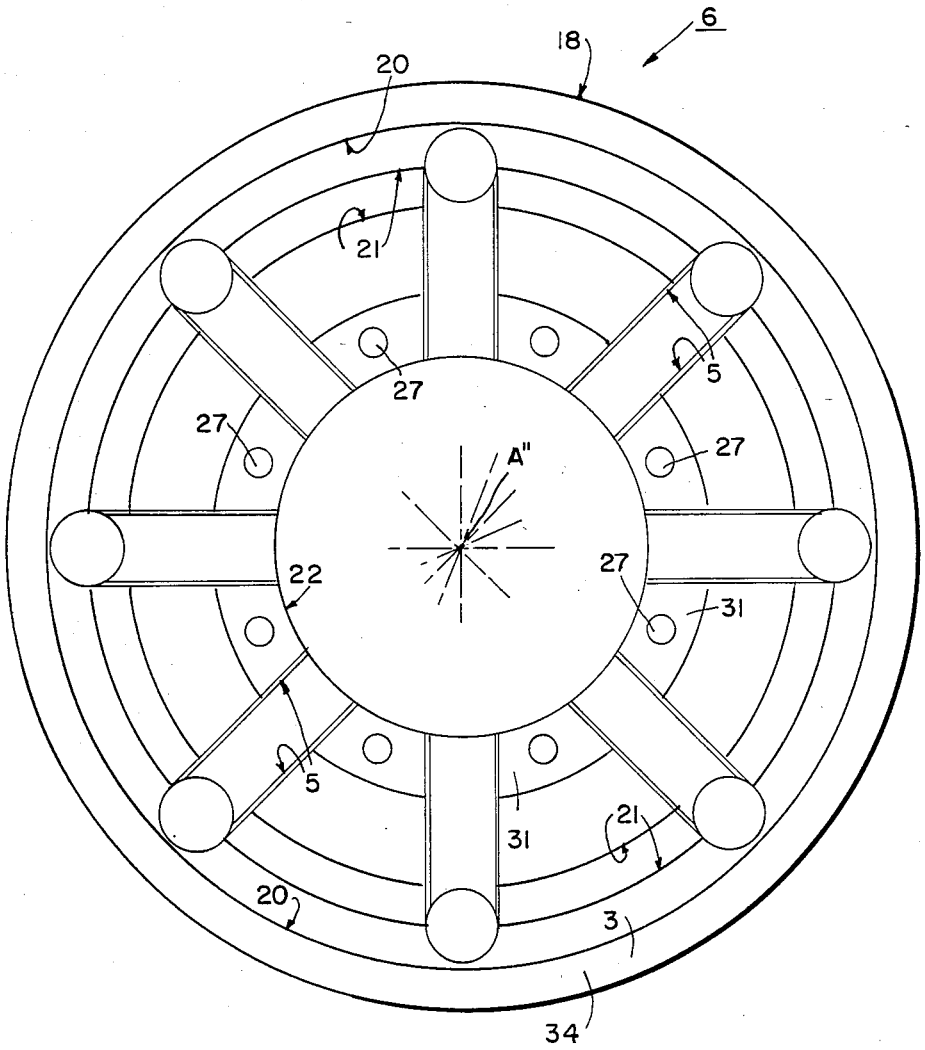
Figure 8:
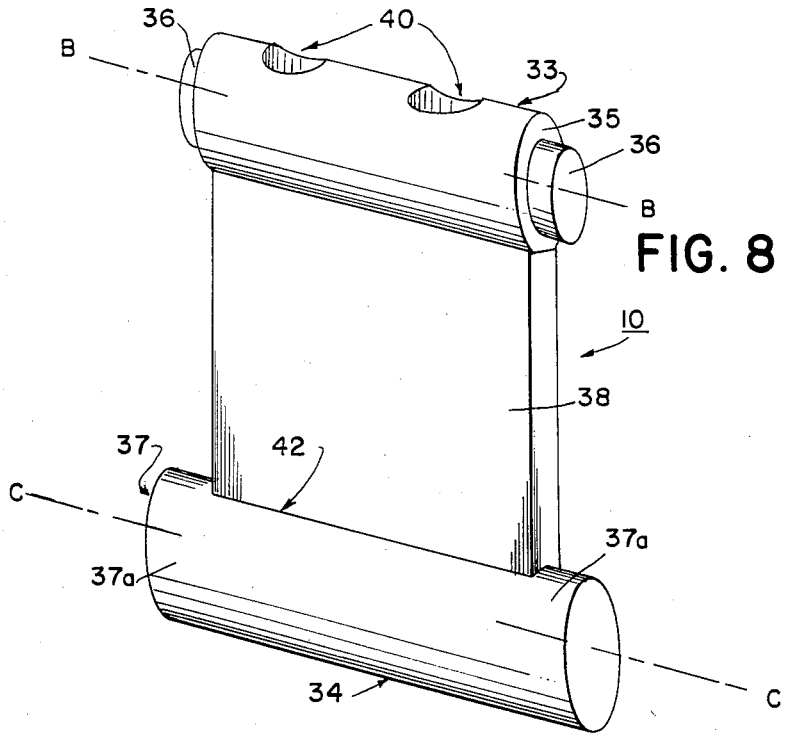
Figure 9:
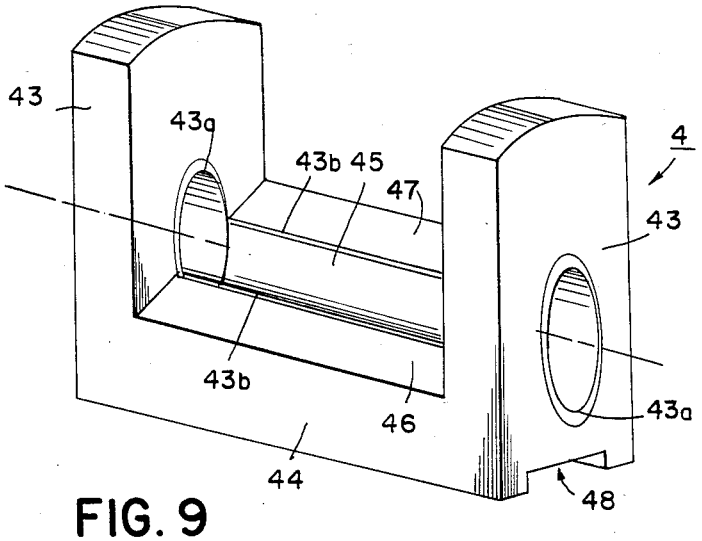

FIG. 1 is a diagram showing stroke-time curves of conventional presses and of the press in accordance with the invention, FIG. 2 is a partial radial section through a press at the start of the die stroke, FIG. 3 is a radial section similar to FIG. 2, but at the end of the die stroke, FIG. 4 is an axial section through the subject of FIG. 3, along line IV—IV, FIGS. 5 and 6 are fragmentary, enlarged sections taken from FIGS. 2 and 3, FIG. 7 is an internal view of one of the parts of the press casing, FIG. 8 is a perspective representation of the important parts of a toggle lever, FIG. 9 is a perspective representation of a body for guiding a die.

In FIG. 1, the time "t" in seconds is plotted on the abscissas and the radial movement of a die is plotted on the ordinates in millimeters. The numerical values themselves are to be considered merely as examples. Also plotted on the ordinates are the values A to E which are explained as follows:

From A to B extends the so-called idle stroke or take-up distance that has to be traveled before the dies are brought from their position farthest out into contact with the cylindrical workpiece surface.

From B to E extends the so-called compression stroke or movement, which in turn can be subdivided into sections: the stroke required for the deformation of the sleeve until the internal sleeve projections make contact with the outer surface of the hose. C to D represents the portion of the compression stroke in which the elastomeric hose material is displaced into the chambers of the sleeve and/or nipple. D to E represents the part of the compression stroke in which the nipple reduces its inside diameter (so-called "nipple shrink"). The nipple shrink should be very slight, yet perceptible, since this is a clear indication of a permanent and secure binding together of hose and fitting.

The straight line running from A through B-3 and C-3 to E is the characteristic of a conventional single-step press system with hydraulic drive. Assuming an equal pump delivery rate, the radial velocity of the dies is constant. It happens that, merely for the take-up distance from A to B-3, a considerable amount of time is lost, and that very little time is available for the flow of the elastomeric material of the tube from C-3 to D-3, so that an undesired material embrittlement, on the one hand, and a correspondingly great nipple shrink on the other hand, have been observed.

The curve from B-3 to E also applies to a radial press in accordance with German Pat. No. 22 14 339. Only the take-up distance from A to B, which is covered in the known system by the manual displacement of the compression ring, can have any other time curve that can also be represented by a line of low slope. The time running up to point B-3, however, is simply lost time; it has no influence whatever on the flow of the fitting parts and of the hose.

The broken curve from A through B-2 (break point), C-2 and D-2, to E characterizes a two-stage radial press in accordance with German Pat. No. 28 44 475. It can be seen that the time required to cover the take-up distance from A to B-2 is substantially less, and that the time available for the pressing action benefits thereby. It is clearly apparent, however, that the time from C-2 to D-2, which is essential for the flow of the elastomeric material, has increased but relatively little. It is true that this markedly improves the conditions, but it is not ideal.

The characteristic curve for the embodiment of the subject matter of the invention to be described below is the continuous curve from A through B-1, C-1, D-1 to E. It is apparent that the time required for the take-up from A to B-1 has been further shortened considerably. The time for the initial compression of the sleeve from B-1 to C-1 is shorter than in the two-stage radial press (from B-2 to C-2). But the time available from C-1 to D-1 for the flow of the elastomeric material of the hose has increased: it is more than twice the conventional times (C-2 to D-2)! The time available for the nipple shrink from D-1 to E has also increased considerably. This, nevertheless, results in a lesser, not greater, nipple shrink, because the preceding substantially greater flow of the elastomeric material permits less deformation of the nipple.

The curve through C-1 represented by the solid line in FIG. 1 can be considered as virtually ideal for the process of pressing such hose-to-nipple junctions. It is obvious that, for the same drive speed, the longer period of time in each case results in a correspondingly greater pressing force, since the leverage ratio from A to E varies continuously and progressively.

In FIG. 2 there is represented a radial press whose axis is identified by A. This axis is identical with the workpiece axis. The broken circle 1 marks the position of the workpiece surface after the end of the pressing action, i.e., the circle also identifies the final position of the contact faces 2 of a total of eight dies 3 disposed in the circle about the axis A. The dies are replaceably fastened each in a guide body 4, each of which is disposed in a radial guide 5 in a press casing 6.

The guide bodies 4 have each an inner pivot 7 on the side away from the dies 3, all of the pivots being situated on a circle concentric with the axis A. A compression ring 8 is mounted in the press casing for rotation likewise concentric with the axis A, and in it an equal number of outer pivots 9 are disposed on a concentric circle at equal distances apart. Between the inner pivots 7 and the outer pivots 9 the toggle levers 10 extend in a certain angular position which will be explained later on in conjunction with FIG. 5; the toggle levers 10 have complementary extremities to form the pivots, the axes of these pivots being all parallel to the axis A and perpendicular to the plane of the drawing.

It is apparent from a consideration of FIG. 2 that, when the compression ring 8 rotates in the direction of the arrow 11, the toggle levers 10 will be turned to an increasingly radial position. This is, of course, possible only if the dies are displaced inwardly in the direction of the arrows 12. This direction is required by the radial guide 5.

In FIG. 3, the same parts as in FIG. 2 are represented in a different position relative to one another, that is, the toggle levers 10 are in a position just before their radial, "extended" position. This is the end position of the compression ring 8 with respect to the radial guides 5 and thus also the end position of the dies 3. As indicated, the position of circle 1 coincides in this case with the position of the contact face 2. This position limit was selected so as not to allow the radial forces to be unlimited, since toggle lever systems can easily produce forces approaching infinity when they are close to their extended position.

FIG. 3 also shows that the compression ring 8 has an arm 13 which is connected by a link 14 to a driver 15 which in the present case is a hydraulic cylinder 16. The hydraulic cylinder 16 is fastened by a pivot shaft 17 to plate-like flanges 30 which are bolted to the press casing 6 and thus transfer the more or less tangential reaction forces to the press casing 6 (see also FIGS. 2 and 4). It can be seen in FIGS. 2 and 3 that the toggle levers are rotatable in a plane that is radial to the axis A, and which coincides with the plane of the drawing or is parallel therewith.

FIG. 4 shows that the press casing 6 consists of two parts 18 and 19 which are in mirror-image symmetry on a radial plane of symmetry E—E, each having a rotational guide means 20 for the compression ring 8. Also present are rotational guide means 21 for the outer pivots 9 of the toggle levers 10 and guiding bodies 4. These rotational guide means 21 serve to keep the toggle levers from dropping out of the outer pivots 9. Without the rotational guide means 21, this could happen because the bearing surfaces surround only about half of the ends of the toggle levers in order to allow the toggle levers to have a sufficiently wide pivoting angle. The rotational guide means, however, serve mainly for the purpose of permitting the dies to be positively withdrawn from the position shown in FIG. 3 to the position shown in FIG. 2 when the compression ring 8 is operated in the direction opposite that of the arrow 11. This has the very considerable advantage of eliminating tangential compression springs between the dies since such springs are subject to fatigue phenomena and do not enable a precisely synchronous return of the dies. By means of the rotational guide means 21, which are concentric with the axis A—A and are interrupted circumferentially only by the radial guides 5 or communicate therewith, a synchronous movement of the dies in the opening direction is also achieved, while they participate in the closing movement only in that they do not interfere with it.

The two casing parts 18 and 19 are in the form of substantially circular bodies and consist of investment or precision castings with appropriately machined guides. They have appropriately dimensioned openings 22 and 23 which are likewise concentric with the axis A—A, leave the dies 3 partially visible, and permit the introduction of a fitting 24 with hose 25. The fitting 24 also includes the sleeve 26. The nipple of the fitting, which is inside of the hose, is not visible.

In the present case, the fitting 24 is one having a pipe elbow, and it is apparent that the extremely short axial length of the radial press makes possible or facilitates the insertion of such fittings.

It can furthermore be seen in the lower part of FIG. 4 that, within the rotational guiding means 20 provided for the compression ring 8 there is a concentric row of bores 27 for bolts 28. The bolts 28 are also shown in FIGS. 2 and 3. The casing parts 18 and 19 are provided adjacent the bolts 28 and bores 27 with inwardly directed, abutting ribs 31 and 32, respectively, which are tightened together by the bolts 28. The ribs lie between cylindrical envelope surfaces, and can be conceived of as parts of an axial ring flange which is interrupted by radial guides 5. As a result, the two casing parts 18 and 19 form a torsion-resistant unit which is insensitive even to those radial forces which act at the rotational guiding means 20 on the circumferential rings 33 and 34 of the casing parts. The two casing parts together produce a large moment of resistance against the load applied at eight points along the rotational guiding means 20. The surface elements of the casing parts can be produced mostly as cast rotational parts which can be made inexpensively and with great precision. This in turn has an influence on the surface quality of the finish-pressed workpiece, which can be seen very easily from the impressions left on it by the dies—the so-called "pressure fields."

The circumferential rings 33 and 34 are integrally formed on the casing parts 18 and 19 and they overlap both sides of the compression ring. Between the confronting faces of the circumferential rings 33 and 34 there is a gap 29 of such a width that the arm 13 of the driver 15 can just move circumferentially within it. It would be possible to provide the gap 29 only in the range of movement of the arm 13, but it is more advantageous from the manufacturing viewpoint to provide the gap 29 around the entire circumference.

The overlap of the circumferential rings 33 and 34 on the compression ring 8 amounts to a total of preferably more than half of the axial length of the compression ring 8. Between the circumferential rings 33 and 34 there are also bearing rings **33*a* and 34*a*** in the form of dry lubricant elements. Such bearing materials are obtainable commercially at this time, so that no further comment is necessary.

The cross section in the bottom half of FIG. 4 is virtually identical with the cross section in the upper half of FIG. 4. The difference in graphic representation is due only to the fact that the cross section taken along line IV—IV of FIG. 3 is at an angle through the press. The casing parts 18 and 19 are provided with grooves **18*a* and 19*a*, seen in the bottom part of FIG. 4, which run in the same direction as two parallel chords in the two casing parts. Projections of plate-like flanges 30 are inserted into these grooves and are joined to the two casing parts by screws 30*a*. The pivot axis 17*a* of the pivot shaft 17 of the driver 15 passes through both flanges, as can also be seen in FIGS. 2 and 3. In this manner the countertorque of the driver 15 is effectively absorbed without the need to abandon the substantially present rotational symmetry of the casing parts 17 and 18**.

It can also be seen in FIG. 4 that the bore 27 for the bolt 28 is a through-bore **27*a* on the left side and a threaded bore 27*b* on the right side. The bolt 28 is consequently inserted and threaded in place from the left side. In the next bore following in the circumferential direction this is precisely reversed, i.e., the through-bore is on the right side and the threaded bore on the left side, so that the bolt is to be inserted from the right side. This alternating position for the installation of the bolts 28 continues in the circumferential direction. By such an angular offset of the through-bores 27*a* and threaded bores 27*b* in the circumferential direction it is brought about that the two casing parts 18 and 19** are identical in plan with regard to the position of the bores, so that the same machining coordinates can be used. The slight departure from mirror-image symmetry which this involves does not, however, have any adverse effect on the overall manner of construction.

In FIG. 5, which shows an enlarged detail of the upper right quadrant of FIG. 2, the following can be seen: In the widest-open position of the dies 3, the longitudinal axis **10*a* of the toggle lever 10 runs at an angle of 70° with the radius R that passes through the inner pivot 7 of the same toggle lever 10. The radial component of force exercised here is accordingly small, but the radial movement of the dies 3 is correspondingly great when the compression ring 8 is turned just a few degrees counterclockwise on the axis A from the position shown in the drawing. The inner pivot 7** is thus shifted inwardly by a corresponding amount in the direction of the radius R.

In the position shown in FIG. 6, which is a detail of the uppermost sector of FIG. 3, the compression ring has been turned by an angular amount of 20° about the axis A. Consequently the angle between the axis **10*a* and the radius R running through the inner pivot 7 now amounts to only 11 degrees, i.e., the toggle lever 10 has swung by an angle of 59 degrees relative to the inner pivot 7. Just before the position of FIG. 6 was reached, the radial component of force was accordingly large, while the radial inward movement of the dies 3 was correspondingly small. The time-motion diagram then corresponded to the solid curve in FIG. 1. It can be seen from FIGS. 5 and 6 also that the pivots 7 and 9 complementing the toggle lever extremities in the guiding bodies 4 and in the compression ring 8, respectively, enclose an angle of only about 180 degrees so as to allow clear space for movement. The manner in which the toggle levers are prevented from dropping out will be explained in greater detail below in conjunction with FIGS. 8 and 9**.

FIG. 7 shows the inside view of one of the casing parts 18 of the press casing 6, in a representation similar to that of FIG. 3. It can clearly be seen that the casing part 18 (and similarly 19) is of a rotationally symmetrical configuration. They are mounted in a press frame (not shown). Since the same reference numbers are used, further explanation is unnecessary.

FIG. 8 shows that the toggle lever 10 has two cylindrical surfaces 33 and 34 disposed at a distance apart from one another. Their axes B—B and C—C, which are parallel to one another and to the axis A—A, define the outer and inner pivot points. The outer cylindrical surface 33 of the toggle lever 10 is the surface of a cylindrical shaft 35 minus a chordal section on the bottom, which has at both ends cylindrical projections 36 for engagement in the rotational guide means 21. The rotational guide means 21 are shown with particular clarity in FIGS. 5 and 6. They prevent the outer ends of the toggle levers 10 from dropping out of the outer pivot points 9. FIGS. 5 and 6, however, show that the rotational guide means 21 communicate with the radial guides 5. This makes it possible to disassemble the guiding bodies 4 and the toggle levers 10 for maintenance work, in the following manner: After the removal of the dies 3 and separating the driver 15 from the arm 13 (FIG. 3), the compression ring 8 can be rotated further counterclockwise from the position in FIG. 6 until the longitudinal axis 10 of the toggle lever coincides with the corresponding radius R. The projections 36 now lose their support on the rotational guiding means 21 and the guiding body 4 can be removed radially inwardly together with the toggle lever 10. In this manner all of the toggle levers can be disassembled successively (and, of course, also be reinstalled in the opposite direction).

As it again appears from FIG. 8, the cylindrical surface 34 of the toggle lever 10 is the surface of a cylindrical shaft 37 also minus a chordal section, which has at both ends cylindrical projections which engage the guiding bodies 4 of the dies 3 (FIG. 9).

In FIG. 8 it can be seen that the two cylindrical shafts 35 and 37 are joined together by an approximately parallelipipedal spacer 38 through which bolts 39 (FIG. 6) are passed from one cylindrical shaft 35 to the other 37. Of these bolts only their two insertion bores 40 can be seen in FIG. 8.

FIG. 9 shows that the guiding body 4 is of a U-shaped configuration and has two legs 43 and a yoke 44. The legs 43 slide in radial guides 5 situated opposite one another (FIG. 4) and by the length of the legs they are effectively protected against canting. The yoke 44 has a semicylindrical bearing surface 45 which serves as an abutment for the cylindrical shaft 37. The bearing surface 45 continues through the two legs 43 but is closed annularly at the top so that the guiding body 4 can be lifted upwardly by the toggle lever 10.

Bearing sleeves 43*a* are inserted into the legs 43, and their length corresponds to the thickness of the legs 43. However, between the legs, i.e., in the area of the semicylindrical bearing surface 45, only a corresponding, semicylindrical bearing liner 43*b* is used, whose inside diameter is identical to that of the bearing liners 43*a*, these diameters corresponding to the outside diameter of the cylindrical shaft 37, allowing for conventional bearing tolerances. Assembly is performed by first passing the cylindrical shaft 37 through the one leg 43 into the area of the bearing surface, until the two ends of the projections 37*a* are flush with the outer ends of the legs 43. Then the spacer 38 is inserted into an appropriately positioned recess 42 and fastened by means of the bolts (FIGS. 4, 6 and 8). The toggle levers 10 and guiding bodies 4 now form a unit which can be taken apart only by removing the bolts.

The yoke 44 has, on both sides of the bearing surface 45, surfaces 46 and 47 which lie together in a steeply inclined plane, as shown also in FIG. 6. In this manner an appropriate range of angular movement is created for the toggle levers 10. On its bottom the guiding body 4 has a recess 48 into which a die 3 is removably inserted.

It is also to be mentioned that, at the pivot points 7 and 9 as well as in the area of the rotational guiding means 20, at which high stresses occur, special bearing materials and bearing parts are used. Bearing materials having dry lubrication are used for such purposes, which are maintenance-free and have a long life.

The geometrical term "cylindrical" applied to the workpiece refers to the original, i.e., undeformed workpiece, but deviations from the precise cylindrical form are entirely permissible. The shapes of the finished product can be greatly varied: cones, double cones, polygons, prisms, barrels, constrictions in the middle, stepped bodies, etc., are conceivable geometrical shapes in addition to cylinders, and they are determined only by the geometry of the contact faces of the dies.

I claim:

1. A radial press for workpiece of cylindrical outer surface, especially for the fastening of fittings individually comprising a sleeve and nipple to hoses by mechanical deformation of the sleeve against a hose situated between the nipple and sleeve, comprising;

toggle levers movable in a radial plane and having inner and outer ends;

a press casing comprising at least two portions having radial guides and guide bodies for a plurality of dies disposed about the axis of the outer surface of the workpiece, each of said portions having an inner pivot for the inner end of each toggle lever;

at least one compression ring portion guided concentrically with said axis, said compression ring portion having outer pivots for said outer ends of said toggle levers; and a drive for the synchronous movement of all dies through the relative rotation of said outer pivots with respect to said inner pivots;

said casing portions being disposed on both sides of said compression ring portion and individually having circumferential rims overlapping said compression ring portion;

rotational guiding means disposed on said circumferential rims, said compression ring portion resting on its entire length against said rims by means of said rotational guiding means;

bolts passing through said casing portions to form a clamped-together, torsion-resistant unit;

there being a radial clearance between said rotational guiding means and said compression ring portion of such a size that any polygonal deformation of said compression ring portion during the pressing is minimized.

2. A radial press in accordance with claim 1, in which said circumferential rims are formed integrally on said casing portions and overlap said compression ring portion from both sides together on more than half of the axial length of said compression ring portion.

3. A radial press in accordance with claim 2, in which said casing portions are substantially of mirror-image symmetrical construction and which includes said rotational guiding means for said outer pivots for said outer ends of said toggle levers and in which said casing portions comprise a concentric series of bores for said bolts.

4. A radial press in accordance with claim 3, in which said casing portions, aside from said radial guides, are made as rotational bodies and which comprises flanges superimposed in the lower portion of said casing portions for the attachment of a drive.

5. A radial press in accordance with claim 3, in which said casing portions have in the region of said bores for said bolts circumferential ribs, inwardly directed and abutting one another, which are clamped together by means of said bolts.

6. A radial press in accordance with claim 5, in which said bores for said bolts are disposed alternately as through-bores and as threaded bores, the through-bore of one casing portion adjoining a threaded bore in the other casing portion.

7. A radial press in accordance with claim 3, in which said toggle levers have two cylindrical surfaces disposed at a distance from one another, whose axes are parallel to one another and to said axis of the outer surface of the workpiece and whose axes represent the inner and outer pivots.

8. A radial press in accordance with claim 7, in which the outer cylindrical surface of each toggle lever is the surface of a cylindrical shaft minus a chordal section, which shaft has at both ends cylindrical projections which engage said rotational guiding means for the outer pivots of the toggle levers.

9. A radial press in accordance with claim 8, in which said rotational guiding means for said projections communicate with said radial guides for the die guide bodies at said outer pivots.

10. A radial press in accordance with claim 9, in which the inner cylindrical surface of each toggle lever is the surface of a cylindrical shaft minus a chordal section, which last-mentioned shaft has at both ends cylindrical projections for engaging a guide body of the die.

11. A radial press in accordance with claim 10, in which two cylindrical shafts are joined together by an approximately parallelipipedal spacer through which bolts are passed from one of said two cylindrical shafts to the other.

12. A radial press in accordance with claim 10, in which said guide bodies of the die are of U-shaped construction having a yoke and legs and in which the legs of the "U" slide in opposite radial guides and in which the yoke of the "U" is the abutment for the cylindrical shaft of the inner pivot and in which projections thereof are engaged in the legs.

13. A radial press in accordance with claim 1, in which the angle of movement at the start of the die stroke and at the end of the die stroke of the toggle levers, with respect to the radii passing through the inner pivots, are between about 70° and about 11°, respectively, and that said compression ring portion cab be pivoted by an angle of about 20° during pressing.

14. A radial press in accordance with claim 1, in which the drive is a fluid drive cylinder and which includes a pressure-related differential control is associated with said cylinder.

* * * * *